US005289928A

United States Patent [19]

Maier

[11] Patent Number: 5,289,928

[45] Date of Patent: Mar. 1, 1994

[54] MINING SHOVEL WITH IMPROVED CENTER GUDGEON BOTTOM RETAINER

[75] Inventor: Charles H. Maier, Milwaukee, Wis.

[73] Assignee: Harnischfeger Corporation, Brookfield, Wis.

[21] Appl. No.: 967,169

[22] Filed: Oct. 27, 1992

[51] Int. Cl.[5] ..... B65G 7/00

[52] U.S. Cl. ..... 212/253

[58] Field of Search ..... 384/591, 592, 593; 212/245, 246, 247, 248, 253

[56] References Cited

U.S. PATENT DOCUMENTS

| | | | |
|---|---|---|---|
| 4,433,954 | 2/1984 | Fujita | 212/253 |
| 4,611,440 | 9/1986 | Kalve | 212/253 |
| 4,769,932 | 9/1988 | Kalve | 212/253 |
| 5,121,561 | 6/1992 | Palfreyman | 212/253 |

*Primary Examiner*—Andres Kashnikow

*Assistant Examiner*—Stephen P. Avila

*Attorney, Agent, or Firm*—Michael Best & Friedrich

[57] ABSTRACT

Apparatus such as a mining shovel or the like, the apparatus comprising a carbody supported for movement over the ground, the carbody including a cylindrical bore centered on a vertical axis. A cylindrical center gudgeon is housed in the cylindrical bore, the center gudgeon including a generally cylindrical outer surface having therein a groove defining a generally horizontal plane, and a flat defined by a vertical, planar surface forming a chord of the outer surface. A bottom retainer includes a plurality of ring segments housed in the groove, and a key having a vertical, planar key inner surface engaging the center gudgeon flat and facing the ends of two of the ring segments. The key is welded to the carbody so that the key is stationary relative to the carbody and prevents rotation of the center gudgeon relative to the carbody.

20 Claims, 3 Drawing Sheets

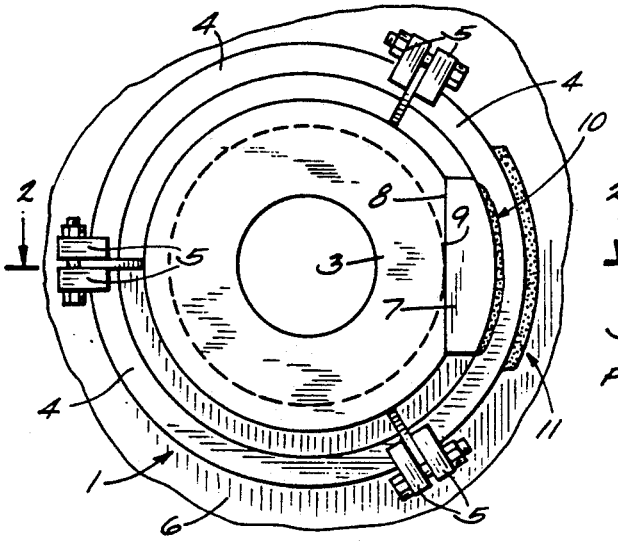
Fig. 1
PRIOR ART
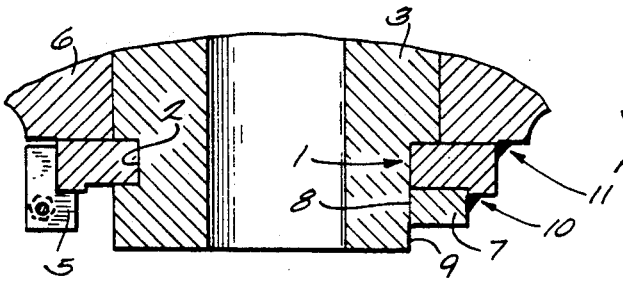
Fig. 2
PRIOR ART
Fig. 8
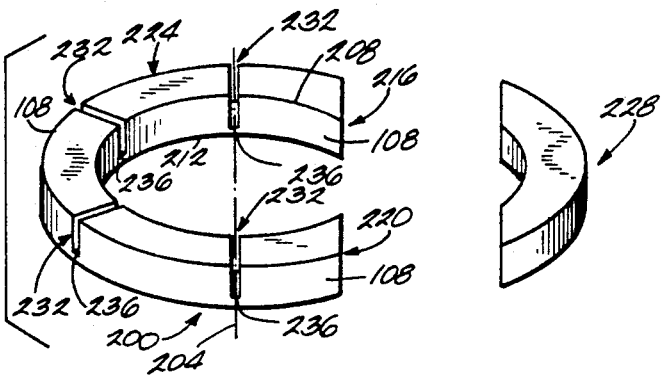
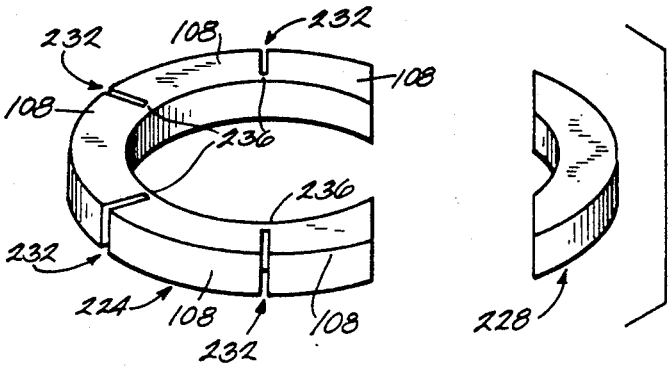
Fig. 9

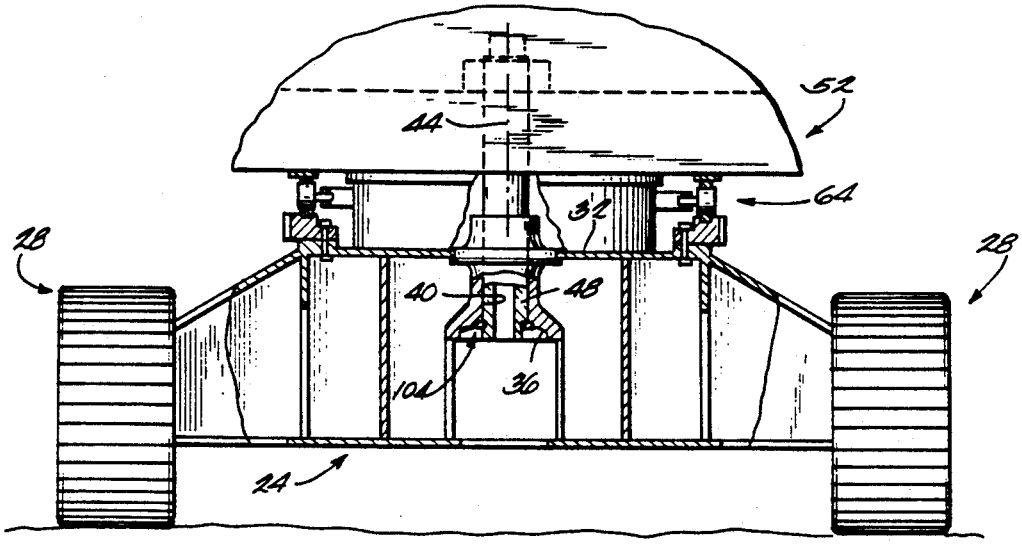
Fig. 4
Fig. 5
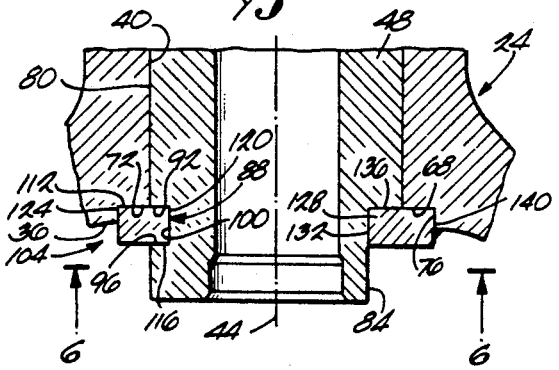
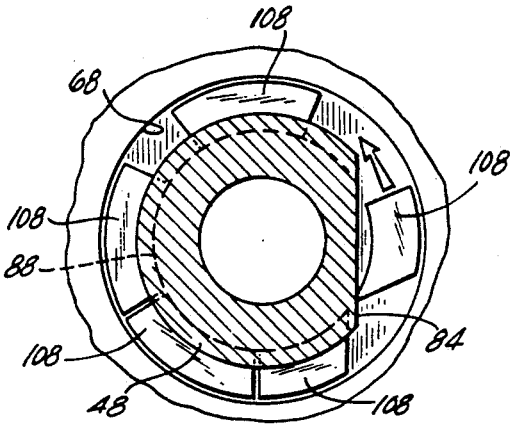
Fig. 7
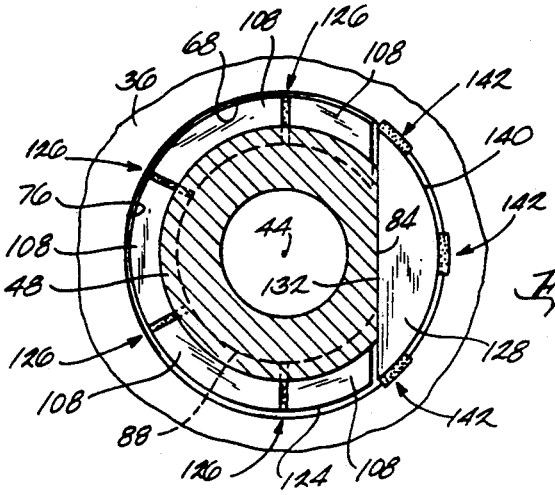
Fig. 6

MINING SHOVEL WITH IMPROVED CENTER GUDGEON BOTTOM RETAINER

BACKGROUND OF THE INVENTION

The invention relates to apparatus such as mining shovels and the like. More particularly, the invention relates to such apparatus in which a revolving frame assembly is rotatable about a center gudgeon supported by a carbody. Still more particularly, the invention relates to the bottom retainer for a center gudgeon.

A conventional mining shovel includes a carbody supported for movement over the ground by a pair of crawler assemblies. The carbody has therein a cylindrical bore centered on a vertical axis, and a cylindrical center gudgeon extends through the bore. The center gudgeon is held into place relative to the carbody primarily by an interference fit. An upper portion of the center gudgeon extends above the carbody, and a revolving frame assembly is rotatable about the upper portion of the center gudgeon. A roller circle surrounds the center gudgeon and rotatably supports the revolving frame assembly above the carbody. A lower portion of the center gudgeon extends below the carbody and includes a circumferential groove and a flat. As a "second line of defense" to prevent the center gudgeon from moving upwardly relative to the carbody, a bottom retainer engages the carbody and the lower portion of the center gudgeon.

A prior art bottom retainer is illustrated in FIGS. 1 and 2. The bottom retainer includes a split collar 1 seated in the groove 2 in the center gudgeon 3. The split collar 1 includes two or more arcuate sections 4. Each arcuate section 4 includes, at its opposite ends, radially outwardly extending ears or lugs 5, and the lugs of adjacent arcuate sections are bolted together to retain the collar sections in the groove 2. The split collar 1 engages the lower surface of the carbody 6 to prevent upward movement of the center gudgeon 3 relative to the carbody in the event the interference fit between the center gudgeon and the carbody fails to prevent such upward movement.

The bottom retainer also includes a key 7 which is located below the split collar 1 and which has a flat surface 8 engaging the flat 9 on the center gudgeon 3. The key is welded to the split collar at 10, and the split collar is welded to the carbody at 11 so that the split collar and the key cannot rotate relative to the carbody. Engagement of the flat on the center gudgeon by the key prevents rotation of the center gudgeon relative to the carbody.

SUMMARY OF THE INVENTION

The invention provides an improved bottom retainer for a center gudgeon. The improved bottom retainer includes a plurality of ring segments welded end-to-end but not welded to the carbody. Unlike in the above-described prior art arrangement, the ring segments do not extend all the way around the center gudgeon. Instead, the ring segments stop at the center gudgeon flat, and the improved bottom retainer includes a key which engages the flat and which is located in the same horizontal plane as the ring segments, rather than below the ring segments. The key is welded to the carbody so that engagement of the center gudgeon flat by the key prevents rotation of the center gudgeon relative to the carbody.

In the preferred embodiment of the invention, the ring segments and the key are seated in a counterbore in the lower surface of the carbody.

The ring segments of the bottom retainer are preferably manufactured by providing a metal ring having a rectangular cross section, and by making two cuts completely through the ring so as to separate the ring into a major arcuate portion (having an arcuate extent of greater than 180° ) and a minor arcuate portion (having an arcuate extent of less than 180° ). The minor arcuate portion is discarded (preferably recycled), and the major arcuate portion is cut almost all the way through, but not all the way through, in one or more locations so as to divide the major arcuate portion into two or more ring segments connected by thin webs of metal. The key is manufactured separately from the ring segments.

Once transported to the site where the mining shovel is being assembled, the metal webs connecting the ring segments are cut so as to completely separate the major arcuate portion into the discrete ring segments forming part of the bottom retainer. Keeping the ring segments together until they are at the assembly site prevents the mixing of segments from different rings. This is desirable because ring segments from different rings may not fit in the groove and counterbore of a particular center gudgeon and carbody assembly.

The improved bottom retainer requires less room for assembly and is less expensive to manufacture than prior art retainers.

DESCRIPTION OF THE DRAWINGS

FIG. 1 is a bottom plan view of a prior art bottom retainer construction.

FIG. 2 is a view taken along line 2—2 in FIG. 1.

FIG. 4 is a view taken along line 4—4 in FIG. 3.

FIG. 5 is an enlarged portion of FIG. 4.

FIG. 6 is a view taken along line 6—6 in FIG. 5.

FIG. 7 is a view similar to FIG. 6 illustrating the manner in which the bottom retainer is assembled.

FIG. 8 is an exploded perspective view illustrating one method of manufacturing the bottom retainer.

FIG. 9 is an exploded perspective view of an alternative method of manufacturing the bottom retainer.

Figure 3:
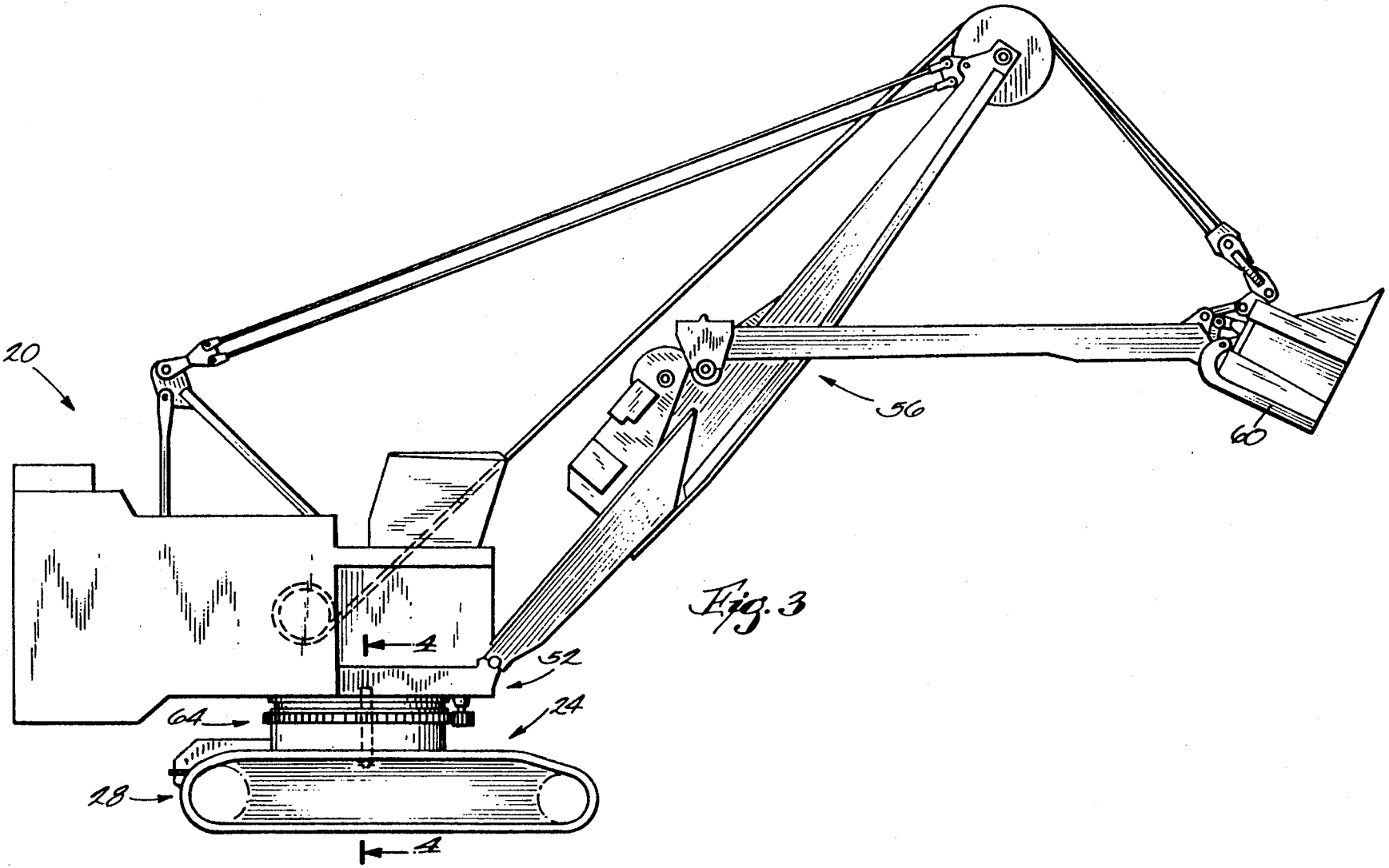
FIG. 3 is a side elevational view of a mining shovel embodying the invention.

Before one embodiment of the invention is explained in detail, it is to be understood that the invention is not limited in its application to the details of the construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

A mining shovel 20 embodying the invention is illustrated in FIGS. 3–6. As is known in the art, the mining shovel 20 comprises (see FIGS. 3 and 4) a carbody 24 supported for movement over the ground by a pair of crawler assemblies 28. The carbody 24 includes (see FIG. 4) an upwardly facing carbody upper surface 32, a downwardly facing carbody lower surface 36, and a cylindrical bore 40 which extends between the upper and lower surfaces 32 and 36 and which is centered on a vertical axis 44. A cylindrical center gudgeon 48 extends through the bore 40 and is held in place primarily by an interference fit between the center gudgeon 48 and the carbody 24. An upper portion of the center gudgeon 48 extends above the carbody 24, and a revolving frame assembly 52 is rotatable about the upper portion of the center gudgeon 48. The revolving frame assembly 52 supports (see FIG. 3) a boom assembly 56, which in turn supports a shovel 60. The revolving frame assembly 52 is rotatably supported above the carbody 24 by a roller circle 64. The portions of the mining shovel 20 thus far described are conventional and need not be described in greater detail. A similar mining shovel is disclosed in U.S. Pat. No. 4,024,969 which is assigned to the assignee hereof and which is incorporated herein by reference.

In the illustrated embodiment of the invention, the carbody lower surface 36 has therein (see FIG. 5) a counterbore 68 concentric with the cylindrical bore 40. The counterbore 68 is defined by a horizontal, annular counterbore upper surface 72 extending outwardly from the cylindrical bore 40, and by a cylindrical, inwardly facing counterbore outer surface 76. The outer surface 76 is concentric with the cylindrical bore 40 and extends downwardly from the counterbore upper surface 72.

The center gudgeon 48 includes a lower portion extending below the carbody lower surface 36. The center gudgeon 48 also includes a generally cylindrical outer surface 80 having a flat 84 defined by a vertical, planar surface. Thus, the flat 84 forms a chord of the cylinder defined by the outer surface 80. The outer surface 80 has therein a groove 88 which defines a horizontal plane 92 and which extends generally along the circumference of the center gudgeon 48. More particularly, the groove 88 extends around the center gudgeon 48 from one end of the flat 84 to the other end of the flat 84. The groove 88 is defined by a horizontal, downwardly facing groove upper surface 92 forming a portion of an annulus. The groove upper surface 92 is coplanar with the counterbore upper surface 72. The groove 88 is also defined by a horizontal, upwardly facing groove lower surface 96 forming a portion of an annulus, and by an outwardly facing groove inner surface 100 forming a portion of a cylinder concentric with the cylindrical bore 40.

The mining shovel 20 also comprises a bottom retainer 104 seated in the groove 88 and in the counterbore 68. The bottom retainer 104 includes (see FIG. 6) a plurality of ring segments 108 housed in the groove 88 and in the counterbore 68. In the illustrated construction, the retainer 104 includes five ring segments 108. Each of the ring segments 108 has a generally rectangular cross section. Each ring segment 108 includes (see FIG. 5) a planar segment upper surface 112 engaging the groove upper surface 92 and the counterbore upper surface 72, and a planar segment lower surface 116 which is parallel to the segment upper surface 112 and which engages the groove lower surface 96. Each segment 108 also includes a segment inner surface 120 which forms a portion of a cylinder and which engages the groove inner surface 100, and a segment outer surface 124 which forms a portion of a cylinder and which engages the counterbore outer surface 76. As shown in FIG. 6, the ring segments 108 are welded end-to-end at 126. As also shown in FIG. 6, the arcuate length of the ring segments 108, after being welded end-to-end, is approximately equal to the arcuate length of the groove 88. In other words, the ring segments 108 do not extend beyond the center gudgeon flat 84.

The bottom retainer 104 also includes a key 128 seated in the counterbore 68. The key 128 has a vertical, planar key inner surface 132 engaging the center gudgeon flat 84 and facing the ends of the two end ring segments 108. The key 128 also has a planar key upper surface 136 engaging the counterbore upper surface 72, and a key outer surface 140 which defines a portion of a cylinder concentric with the cylindrical bore 40 and which engages the counterbore outer surface 76. The key upper surface 136 is coplanar with the segment upper surfaces 112. As shown in FIGS. 5 and 6, the key 128 is welded to the carbody 24 at 142 so that the key 128 is stationary relative to the carbody 24. Consequently, engagement of the center gudgeon flat 84 by the key 128 prevents rotation of the center gudgeon 48 relative to the carbody 24.

The manner in which the bottom retainer 104 is assembled is illustrated in FIG. 7. First, the center gudgeon 48 is located in the cylindrical bore 40 such that the groove upper surface 92 is flush with the counterbore upper surface 72. Next, the ring segments 108 are inserted, one at a time, into the groove 88 and the counterbore 68. After the center gudgeon is properly located relative to the carbody 24, a ring segment can be inserted into the groove 88 only by placing the segment 108 in the space between the counterbore outer surface 76 and the center gudgeon flat 84 and then sliding the segment along the counterbore outer surface 76 and into the groove 88. Accordingly, the arcuate length of each ring segment 108 must be short enough so that, as shown in FIG. 7, the segment will fit in the space between the counterbore outer surface 76 and the center gudgeon flat 84. This is why, in the illustrated construction, five ring segments 108 each having an arcuate length of not more than sixty degrees are provided. Once properly located in the center gudgeon groove 88, the ring segments 108 are welded end-to-end. Finally, the key 128 is located in the space between the center gudgeon flat 84 and the counterbore outer surface 76 and is welded to the carbody 24.

A method of manufacturing the ring segments 108 is illustrated in FIG. 8. First, a ring 200 having a rectangular cross section and a central axis 204 is manufactured. Preferably, although not shown in the drawings, the two radially inner corners 208 and 212 of the ring 200 are beveled. Next, the ring 200 is cut in two locations. The cuts, identified by reference numerals 216 and 220 in FIG. 8, define a plane which is parallel to the axis 204 and which forms a chord of the ring 200. The cuts 216 and 220 pass completely through the ring 200 so as to separate the ring into a major arcuate portion 224 and a minor arcuate portion 228. The minor arcuate portion 228 is not used in manufacturing the bottom retainer 104. It is preferably recycled. Next, four cuts 232 are made substantially completely through (but not all the way through) the major arcuate portion 224 such that the major arcuate portion 224 is divided into the five ring segments 108, with adjacent ring segments 108 being joined by a thin web 236 of metal. The key 128 is manufactured separately.

After the major arcuate portion 224 of the ring has been transported to the site where the mining shovel 20 is being assembled, the webs 236 connecting the ring segments 108 are cut so as to completely separate the major arcuate portion 224 into the five ring segments 108. The ring segments 108 are then inserted into the center gudgeon groove 88, as described above, and are welded end-to-end. The key 128 is then properly located and welded to the carbody 24.

The cuts 232 illustrated in FIG. 8 extend vertically and downwardly into the ring 200. It should be understood that the cuts 232 could alternatively, as shown in FIG. 9, extend horizontally.

Various features of the invention are set forth in the following claims.

I claim:

1. Apparatus such as a mining shovel said apparatus comprising a carbody supported for movement over the ground, said carbody including an upwardly facing carbody upper surface, a downwardly facing carbody lower surface, and a cylindrical bore which extends between said upper and lower surfaces and which is centered on a vertical axis, a cylindrical center gudgeon which is housed in said cylindrical bore and which includes lower portion extending below said carbody lower surface, a generally cylindrical outer surface having therein a groove defining a generally horizontal plane, and a flat defined by a vertical, planar surface forming a chord of said outer surface, and a retainer including a plurality of ring segments housed in said groove, said segments including respective horizontal segment upper surfaces, and said retainer also including a key having a vertical, planar key inner surface engaging said center gudgeon flat, and a horizontal key upper surface coplanar with said segment upper surfaces, and said key being welded to said carbody so that said key is stationary relative to said carbody and prevents rotation of said center gudgeon relative to said carbody.

2. Apparatus as set forth in claim 1 and further comprising a revolving frame assembly rotatable about said upper portion of said center gudgeon, and means rotatably supporting said revolving frame assembly above said carbody upper surface.

3. Apparatus as set forth in claim 2 wherein said supporting means includes a roller circle surrounding said center gudgeon.

4. Apparatus as set forth in claim 1 wherein said groove is defined by a horizontal, downwardly facing, groove upper surface forming a portion of an annulus, a horizontal, upwardly facing groove lower surface forming a portion of an annulus, and an outwardly facing groove inner surface forming a portion of a cylinder concentric with said cylindrical bore, wherein each of said segments has a generally rectangular cross section and includes a segment lower surface engaging said groove lower surface, and wherein said segment upper surfaces engage said groove upper surface.

5. Apparatus as set forth in claim 1 wherein said ring segments are welded end-to-end.

6. Apparatus such as a mining shovel said apparatus comprising a carbody supported for movement over the ground, said carbody including an upwardly facing carbody upper surface, a downwardly facing carbody lower surface, and a cylindrical bore which extends between said upper and lower surfaces and which is centered on a vertical axis, and said lower surface having therein a counterbore surrounding said cylindrical bore, a cylindrical center gudgeon which is housed in said cylindrical bore and which includes an upper portion extending above said carbody upper surface, a lower portion extending below said carbody lower surface, and a generally cylindrical outer surface having therein a groove which defines a plane perpendicular to said axis and which is aligned with said counterbore, a retainer including a plurality of ring segments housed in said groove and in said counterbore, a revolving frame assembly rotatable about said upper portion of said center gudgeon, and means rotatably supporting said revolving frame assembly above said carbody upper surface.

7. Apparatus as set forth in claim 6 wherein said supporting means includes a roller circle surrounding said center gudgeon.

8. Apparatus as set forth in claim 6 wherein said counterbore is defined by a horizontal, annular counterbore upper surface extending outwardly from said cylindrical bore, and by a cylindrical, inwardly facing counterbore outer surface which is concentric with said cylindrical bore and which extends downwardly from said counterbore upper surface, wherein said groove is defined by a horizontal, downwardly facing, groove upper surface forming a portion of an annulus, a horizontal, upwardly facing groove lower surface forming a portion of an annulus, and an outwardly facing groove inner surface forming a portion of a cylinder concentric with said cylindrical bore, and wherein each of said segments has a generally rectangular cross section and includes a segment upper surface engaging said groove upper surface and a segment lower surface engaging said groove lower surface.

9. Apparatus as set forth in claim 8 wherein said center gudgeon also includes a flat defined by a vertical, planar surface forming a chord of said outer surface, and wherein said retainer also includes a key having a vertical, planar key inner surface engaging said center gudgeon flat and the ends of two of said ring segments, said key also having a horizontal key upper surface engaging said counterbore upper surface, and a key outer surface which defines a portion of a cylinder concentric with said cylindrical bore and which engages said counterbore outer surface, and said key being welded to said carbody so that said key is stationary relative to said carbody and prevents rotation of said center gudgeon relative to said carbody.

10. Apparatus as set forth in claim 6 wherein said center gudgeon also includes a flat defined by a vertical, planar surface forming a chord of said outer surface, and wherein said retainer also includes a key having a vertical, planar key inner surface engaging said center gudgeon flat, said key being welded to said carbody so that said key is stationary relative to said carbody and prevents rotation of said center gudgeon relative to said carbody.

11. Apparatus as set forth in claim 6 wherein said ring segments are welded end-to-end.

12. Apparatus such as a mining shovel said apparatus comprising a carbody supported for movement over the ground, said carbody including an upwardly facing carbody upper surface, a downwardly facing carbody lower surface, and a cylindrical bore which extends between said upper and lower surfaces and which is centered on a vertical axis, and said lower surface having therein a counterbore which is concentric with said cylindrical bore and which is defined by a horizontal, annular counterbore upper surface extending outwardly from said cylindrical bore, and by a cylindrical, inwardly facing counterbore outer surface which is concentric with said cylindrical bore and which extends downwardly from said counterbore upper surface, a cylindrical center gudgeon which is housed in said cylindrical bore and which includes an upper portion extending above said carbody upper surface, a lower portion extending below said carbody lower surface, and an outer surface having therein a groove defined by a horizontal, downwardly facing groove upper surface forming a portion of an annulus, a horizontal, upwardly facing groove lower surface forming a portion of an annulus, and an outwardly facing groove inner surface forming a portion of a cylinder concentric with said cylindrical bore, said groove upper surface being coplanar with said counterbore upper surface, and said center gudgeon also including a flat defined by a vertical, planar surface forming a chord of the cylinder defined by said groove inner surface, a retainer including a plurality of ring segments housed in said groove and in said counterbore, each of said segments having a generally rectangular cross section and including a segment upper surface engaging said groove upper surface and said counterbore upper surface, and a segment lower surface engaging said groove lower surface, said ring segments being welded end-to-end, and said retainer also including a key having a vertical, planar key inner surface engaging said center gudgeon flat and facing the ends of two of said ring segments, said key also having a horizontal key upper surface engaging said counterbore upper surface, and a key outer surface which defines a portion of a cylinder concentric with said cylindrical bore and which engages said counterbore outer surface, and said key being welded to said carbody so that said key is stationary relative to said carbody and prevents rotation of said center gudgeon relative to said carbody, a revolving frame assembly rotatable about said upper portion of said center gudgeon, and means rotatably supporting said revolving frame assembly above said carbody upper surface.

13. A method of making and assembling a retainer for the center gudgeon of a mining shovel, said method comprising the steps of providing a ring having a rectangular cross section and having a central axis, making two cuts completely through said ring, said cuts defining a plane which is parallel to said axis and which forms a chord of said ring, and said cuts separating said ring into a major arcuate portion and a minor arcuate portion, and cutting substantially completely through said major arcuate portion in at least one location such that said major arcuate portion is divided into at least two segments joined by a thin web of material.

14. A method as set forth in claim 13 and further comprising the step of cutting completely through said major arcuate portion in said at least one location such that said major arcuate portion is separated into said at least two segments.

15. A method as set forth in claim 14 and further comprising the step of inserting said segments into the groove of the center gudgeon.

16. A method as set forth in claim 15 and further comprising the step of welding said segments end-to-end.

17. A method of assembling the carbody and center gudgeon of a mining shovel, the center gudgeon having therein a groove and the carbody including a lower surface having therein a counterbore aligned with the groove in the center gudgeon, said method comprising the steps of providing a retainer comprising a plurality of ring segments forming the major arcuate portion of a ring, inserting said segments into the groove of the center gudgeon and the counterbore of the carbody, and welding said segments end-to-end.

18. A method as set forth in claim 17 wherein the center gudgeon has thereon a flat, and wherein said method further comprises the steps of providing a key having a planar key inner surface, inserting said key into the counterbore so that said key inner surface engages the center gudgeon flat and the ends of two of said ring segments, and welding said key to the carbody so that said key is stationary relative to the carbody and prevents rotation of the center gudgeon relative to the carbody.

19. A method as set forth in claim 17 wherein said providing step includes the steps of providing the major arcuate portion of a ring cut substantially completely therethrough in at least one location such that said major arcuate portion is divided into at least two ring segments joined by a thin web of material, and cutting each web to separate said major arcuate portion into said ring segments.

20. A method as set forth in claim 17 wherein the groove and the counterbore define a passageway surrounding the center gudgeon and having a circular axis in a plane perpendicular to the axis of the center gudgeon, and wherein said inserting step includes the step of inserting said ring segments into the passageway in the direction of the passageway axis.

* * * * *